United States Patent [19]

Marschak

[11] Patent Number: 4,594,822

[45] Date of Patent: Jun. 17, 1986

[54] STRUCTURAL PANEL FOR BUILDING STRUCTURE

[76] Inventor: Howard J. Marschak, 2030 Silvertip La., Long Beach, Michigan City, Ind. 46860

[21] Appl. No.: 490,247

[22] Filed: May 2, 1983

[51] Int. Cl.[4] ..... E04B 7/02

[52] U.S. Cl. ..... 52/90; 52/92; 52/376; 52/588

[58] Field of Search ..... 52/90, 529, 530, 531, 52/588, 459, 460, 461, 462, 463, 92, 262, 584, 639, 642, 644, 376, 778, 779, 361, 285, 286, 751, 752, 783, 784, 344, 349, 350, 93

[56] References Cited

U.S. PATENT DOCUMENTS

| | | | |
|---|---|---|---|
| 798,669 | 9/1905 | Garland | 52/543 |
| 824,964 | 7/1906 | Vaughn | 52/285 |
| 1,141,021 | 5/1915 | Taylor | 52/90 |
| 1,271,350 | 7/1918 | Moon | 52/90 |
| 1,452,599 | 4/1923 | Hames | 52/90 |
| 2,180,317 | 11/1939 | Davis | 52/588 |
| 2,722,901 | 11/1955 | Johnson et al. | 52/90 |
| 3,199,258 | 8/1965 | Jentoft et al. | 52/461 |
| 3,289,375 | 12/1966 | Cline | 52/584 |
| 3,820,295 | 6/1974 | Folley | 52/270 |
| 3,928,951 | 12/1975 | Murphy | 52/92 |
| 3,940,893 | 3/1976 | Rausch et al. | 52/468 |
| 3,969,866 | 7/1976 | Kyne | 52/588 |
| 4,133,155 | 1/1979 | Oelrich | 52/376 |
| 4,156,999 | 6/1979 | Avery | 52/376 |
| 4,168,596 | 9/1979 | Yoder, Jr. | 52/462 |
| 4,333,289 | 6/1982 | Strickland | 52/376 |
| 4,388,789 | 6/1983 | Murphy | 52/461 |
| 4,389,829 | 6/1983 | Murphy | 52/90 |
| 4,445,302 | 5/1984 | Dean | 52/543 |

FOREIGN PATENT DOCUMENTS

| | | | |
|---|---|---|---|
| 1256390 | 12/1967 | Fed. Rep. of Germany | 52/463 |
| 541001 | 12/1976 | U.S.S.R. | 52/361 |

*Primary Examiner*—John E. Murtagh
*Assistant Examiner*—Andrew Joseph Rudy
*Attorney, Agent, or Firm*—Robert E. Wagner; Ralph R. Rath

[57] ABSTRACT

A building panel includes a main body having flanges extending from lateral edges and configured to have a portion in abutting, interconnected relation when two panels are in assembled relation and the remainder defining a slot for receipt of standard building studs. The panel is configured to fit between adjacent studs having standard sixteen-inch spacing so that a building structure can be formed using one type of panel and accompanying components which can be assembled without special tools.

20 Claims, 14 Drawing Figures

100
102
104
108
110
112
106
22
90
72
24
92
94
130
32a
138
46
30a
44
36a
42
32a
20
62
26
28
160
134
150
140
136
144
152
142
154
138
32
40
66
74
68
70
34
72
54
42
50
44
46
56
52
5
160
140
130
160
134
136
132
138

32
30
36
38
62
24
78
34
40
46
42
44
92
94
96
26
78a
76
74
70
72
120
122
124
126

STRUCTURAL PANEL FOR BUILDING STRUCTURE

TECHNICAL FIELD

The present invention relates generally to building constructions and, more particularly, to an improved structural panel for use in erecting buildings and ancillary components used in connection therewith.

BACKGROUND PRIOR ART

The use of pre-formed panels for erecting building structures has been known for many years. Examples of various types of building structural components are disclosed in U.S. Pat. Nos. 3,820,295; 3,969,866; and, 4,168,596, all incorported herein by reference.

In the construction industry, particularly residential construction, certain standards have been deaveloped which are used almost universally. For example, most residential constructions utilize the standard "two-by-four" studding for the outer walls, as well as the partitions defining the inner walls in a residence. Conventionally, the roof structure is formed utilizing larger support members or studding, such as "two-by-six" or "two-by-eight" studs or rafters. In all instances, the center-to-center spacing between two adjacent studs or rafters or joists has been standardized to be 16-inches.

While certain construction components have been somewhat standardized to fit the needs of the industry, such as the conventional "4×8" sheet or panel that is utilized and can cover a span of three adjacent studs, there still remains a need for panel construction that can be utilized and have more universal applicability in the building industry.

SUMMARY OF THE INVENTION

According to the present invention, a unique structural panel has been developed which can be utilized with conventional studding and is configured to span the space between an adjacent pair of building studs. More specifically, the structural panel is designed to have 16-inch center-to-center or edge-to-edge spacing and a particular flange configuration so that the panel can be secured directly to the building studs and can be utilized for forming exterior walls, interior walls, as well as the roof structure of a conventional building.

The structural panel consists of a main body having parallel, lateral edges that each have a first flange extending substantially perpendicular to the main body adjacent the lateral edge, a second flange extending inwardly under the main body, and a third flange extending away from the main body generally perpendicular thereto. The two first flanges on opposite lateral edges are spaced approximately 16-inches on a center-to-center basis so that these flanges will be centered on two adjacent studs when the panel is erected between the two studs.

The second and third flanges cooperate to be in abutting relation with the two adjacent surfaces of the studding to be secured directly thereto and the second and third flanges of two adjacent panels cooperate to completely enclosed the exposed edge of the studding to which it is attached.

In one embodiment of the invention, the panel has a center ridge and inclined walls between the center ridge and the lateral edges with an upwardly-inclined flange extending between the lateral edges and the upper ends of the first flanges to define an inverted V-shaped groove on each lateral edge to provide reinforcement for the main body of the panel.

The first flanges of the panel also have interconnecting means to interconnect adjacent panels, which are preferably in the form of tabs bent from the main body of the first flange. These tabs can then be bent through openings in adjacent flanges so that the adjacent panels are rigidly interconnected. The third flanges preferably have nail openings provided therein and a pair of parallel slits extend from each of the nail openings to define tabs that are bendable perpendicular to the body of the third flange to be utilized as connecting means, when desired.

The building structure of the present invention also envisions the use of specifically-configured cap means to enclose the space between the flanges of a structural panel, as well as side cap means for enclosing the exposed edge of one panel, such as the end panel of a roof structure.

In a modified form of the invention, a further folded portion is located between the inclined flange and the first flange and cooperate with the first flange to define a V-shaped structure on the opposite side of the flange on one lateral edge, which is adapted to receive the V-shaped structure on the opposite lateral edge of the next adjacent panel so that the structures cooperate to seal the space between adjacent panels.

The building structure of the present invention also incorporates a novel support mechanism that is supported on the upper end of the side wall and cooperates with a bracket on the roof structure to support the roof on the side wall.

The building structure of the present invention also incorporates a simplified ridge structure which can easily be attached to enclose the space between opposite sides of the roof structure and can be attached to the roof structure panels without any special tools.

BRIEF DESCRIPTION OF SEAVERAL VIEWS OF DRAWINGS

Figures 1, 3, 3A, 4, 5:
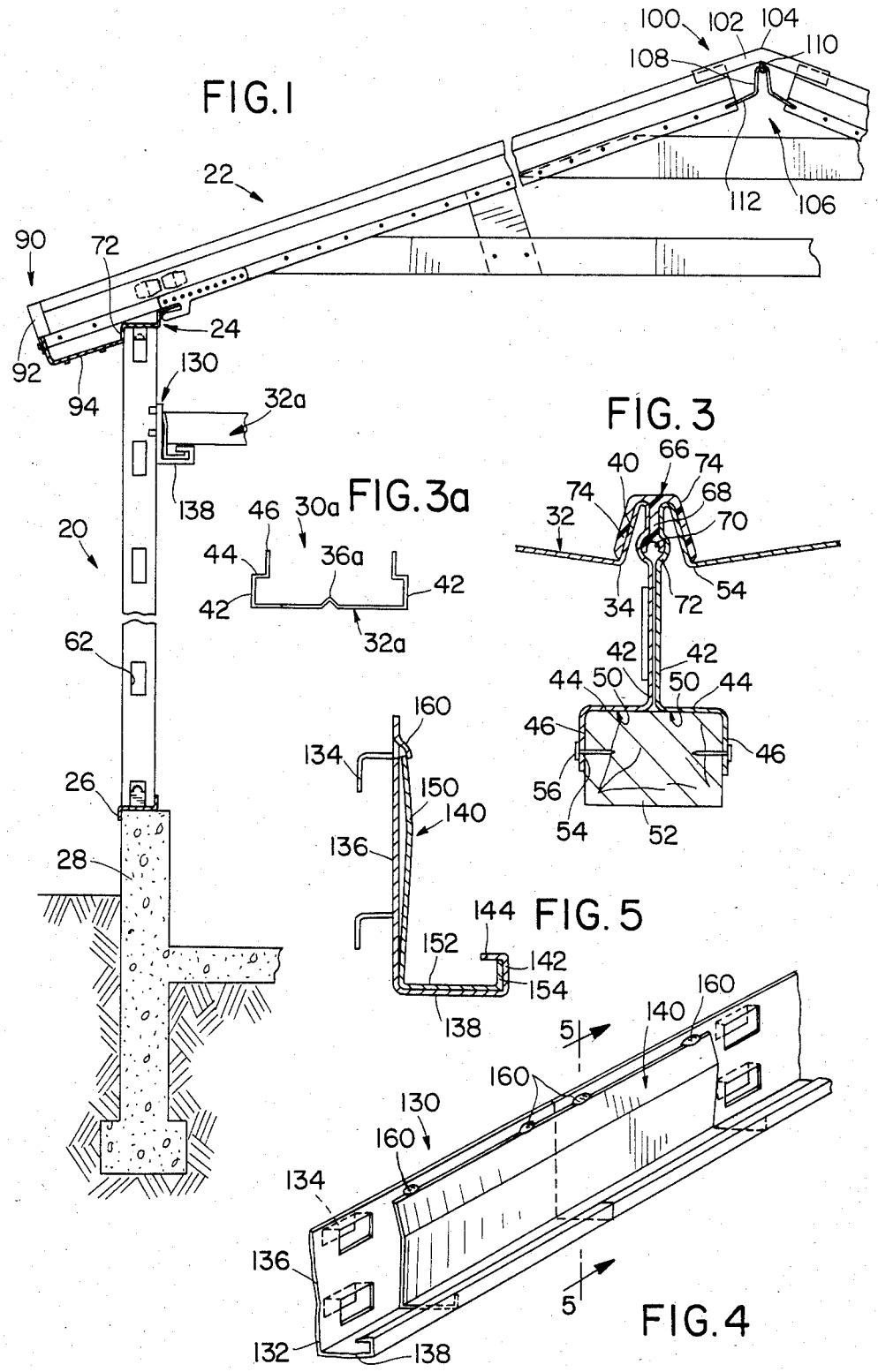
FIG. 1 is a fragmentary side view of a building structure constructed utilizing the panel construction of the present invention.
FIG. 3 is a cross-sectional view of two adjacent panels in assembled condition.
Figures 2, 6, 7, 8, 9:
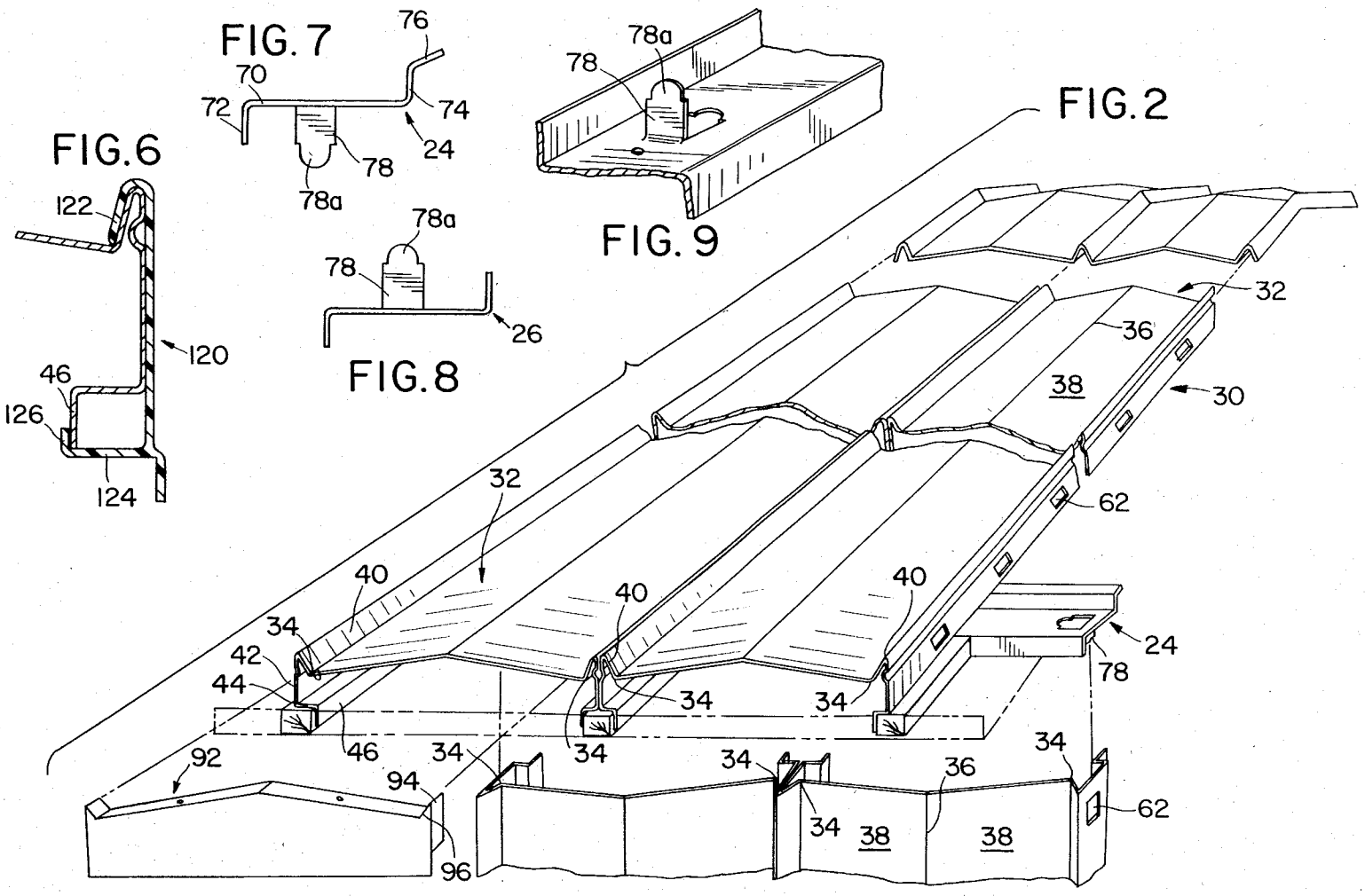
FIG. 2 is an exploded view of the upper end of the side wall and the lower end of the roof structure.
Figure 10:
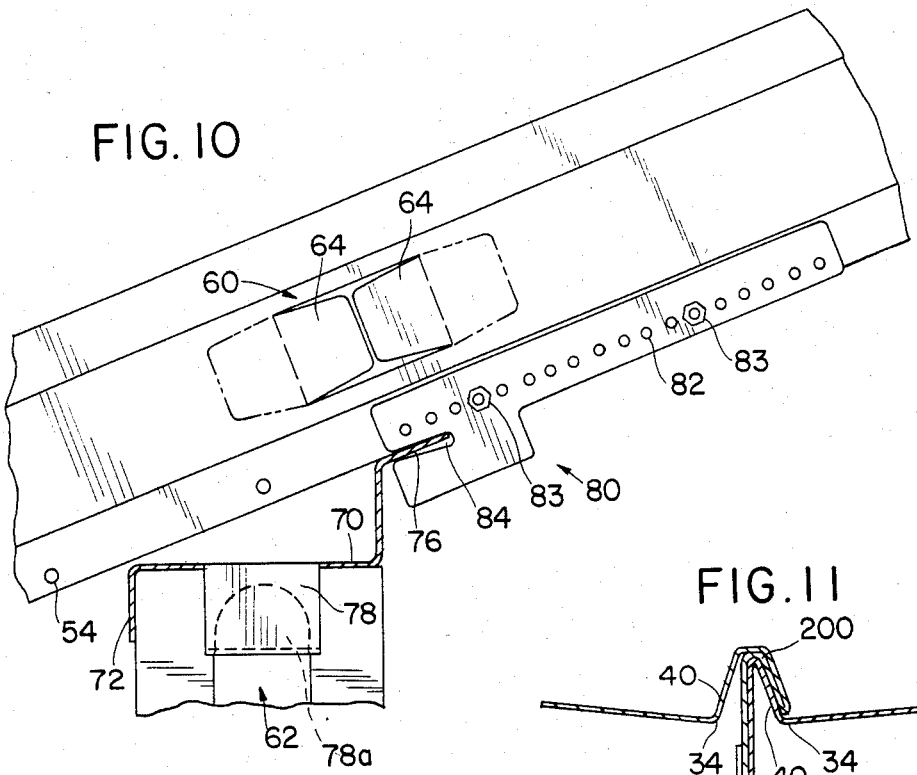
Figure 11:
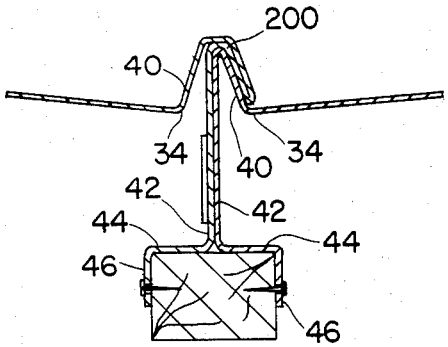
Figure 13:
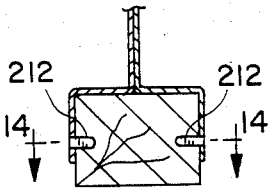
Figure 12:
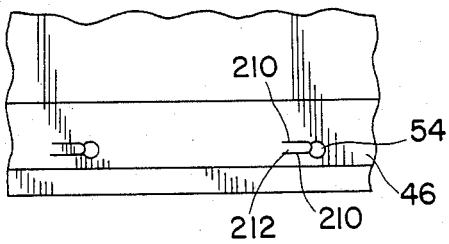
Figure 14:
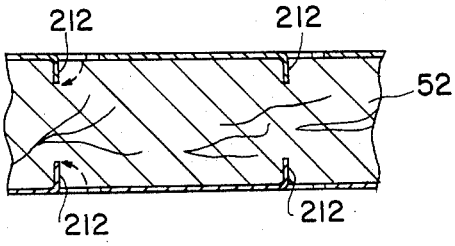

FIG. 3*a* is an end view of a ceiling panel to be used in conjunction with a floor in a multi-story structure;

FIG 4 is a perspective view of a support structure with interconnecting means between adjacent members;

FIG. 5 is a cross-sectional view as viewed along 5—5 of FIG. 4;

FIG. 6 a cross-sectional view of a side cap means for enclosing the flanges of an exposed side of a panel, such as the end of the roof structure;

FIG. 7 is an end view of the top cap member shown on the upper end of the side wall in FIG. 1;

FIG. 8 is an end view of the lower cap member on the lower end of the side wall shown in FIG. 1;

FIG. 9 is a fragmentary perspective view showing the configuration of the tab-connecting means;

FIG. 10 is an enlarged fragmentary side view of the connection between the upper end of the side wall and the adjacent roof structure;

FIG. 11 is a cross-sectional view similar to FIG. 3 showing a slightly modified form of the invention;

FIG. 12 is a fragmentary side view of the flange structure showing the opening means for insertion of fasteners;

FIG. 13 is a cross-sectional view showing the tab structures utilized for securing the panel to the studding; and, FIG. 14 is a cross-sectional view as viewed along line 14—14 of FIG. 13.

DETAILED DESCRIPTION

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings shows a fragmentary portion of a building structure including a side wall 20 and a roof structure 22 with support means 24 on the upper end of the side wall, which is supported at its lower end on a base-locking plate 26 carried by the upper edge of a concrete footing structure 28.

According to the present invention, the entire side wall and roof structure are constructed from identical panels that are configured to be disposed between adjacent standard-spacing studding that has a conventional width. More specifically, the respective panels are configured to span a 16-inch center-to-center spacing between two adjacent studs, which are preferably of conventional size, such as a "two-by-four", "two-by-six" or "two-by-eight".

The substantially identical panels, designated by reference numeral 30, are illustrated in FIGS. 2 and 3. As shown in FIG. 2, each panel has a main body 32 having opposite lateral edges 34. The main body 32 preferably is in the form of a center ridge 36 with inclined walls 38 extending from the center ridge to the respective lateral edges 34.

In the embodiment illustrated in FIGS. 2 and 3, the opposite lateral edges 34 have upwardly-inclined flanges 40 that are integral at their upper ends with a generally vertical flange 42 that extends downwardly away from the inclined flange 40 and cooperates therewith to define a generally inverted, open V-shaped structure providing rigid reinforcement along the lateral edges. Each first flange 42 has a second flange 44 integral with the lower free end thereof which extends perpendicular to the first flange and inwardly under the main body 32. A third flange 46 extends perpendicular from the free edge of the second flange 44. As illustrated in FIG. 3, the flanges 44 and 46 are configured such that they will define an open slot or groove 50 that is dimensioned so that two adjacent slots or gooves 50 form a closed slot 50 that snuggly receives the width of a standard building stud 52. Thus, any size stud can be utilized with the structural panel without any modification thereof since with any increase in size beyond a standard "two-by-two" or "two-by-four" dimension, the additional dimension will extend away from the structural panel to be utilized for attaching other structures thereto, such as the interior wall for a building. The respective third flanges also have spaced openings 54 so that nails or fastening means 56 can be utilized for securing the respective panels to the studding 52.

According to one aspect of the invention, the adjacent panels are adapted to be interconnected to each other without the use of any special tools. For this purpose, as illustrated in FIG. 10, one first flange 42 has spaced fastening means 60 formed integral therewith, while the opposite first flange of each panel has openings 62 (FIG. 2) for receiving the fastening means 60. The fastening means 60 is in the form of tabs 64 cut out from the main body of the flange 42 and bendable to extend through the opening 62 and be bent into juxtaposed relation with the inner surface of the adjacent flange. As indicated above, the respective panels are dimensioned to be received between adjacent studs having a standard center-to-center spacing of 16-inches. Thus, the respective flanges 42 extending from opposite lateral edges 34 are spaced by a dimension of approximately 16-inches. With this arrangement, the entire wall structure and roof structure can be formed utilizing a single configuration of paneling.

The spacing between adjacent rectangular openings 62 is preferably equal and the tabs 64 have the same spacing. Thus, for example, the openings could be spaced from each other 12-inches center-to-center, while the centers of the ends of tabs 64 could likewise be in such 12-inch spacing so that the tabs will always be appropriately aligned with the openings.

In the embodiment illustrated in FIGS. 2 and 3, sealing means 66 are utilized to seal the exposed edges of the adjacent panels to provide a water-tight structure. This sealing means 66 is illustrated in FIG. 3 and consists of a member having a center leg 68 that extends between two adjacent first flanges 42 and has an enlarged portion 70 received into generally circular configured grooves 72 in the respective first flanges 42 to be secured therein without the use of any fasteners. A pair of outer legs 74 extend from the upper end of the center leg 68 and overlie the outer surfaces of the inclined flanges 40 to provide a proper seal. The sealing means is easily installed by assembly over a loose panel prior to assembly adjacent to an installed panel.

According to a further aspect of the present invention, the base plate 26 and the top plate or connector 24 (FIG. 1) are again designed such that they can be easily assembled on the wall structure without the use of any special, tools. Thus, the upper support means 24 (FIG. 7) for supporting the roof structure consists of a generally flat member 70 that is adapted to extend the entire width of the upper end of the side walls 20 and have a downwardly-depending flange 72 extending from one edge thereof. An upwardly-extending flange 74 extends from the opposite end of the top plate 70 and has an inclined portion 76 at the outer end which has an angle of inclination that is equal to the angle of the inclined roof structure. The center of the top plate has spaced depending tab structures 78 deformed from the body portion thereof and the tabs are on 16-inch spacings so that the respective tabs are aligned with the first flanges of adjacent panels when in assembled condition. The lengths of the tabs 78 are such that the bendable end portions 78A are aligned with a rectangular opening 62 adjacent the upper end of the side wall 22.

Likewise, the lower end or lower plate 26 (FIG. 8) substantially Z-shaped in cross-section and has identical tabs 78 and bendable portions 78A to be aligned with a rectangular opening 62 so that a bendable tab portion 78 can be bent through the rectangular opening and secure the plate to the side wall.

The interconnection between the roof structure and the upper end of the side walls is illustrated in FIG. 10 and includes a plurality of identical brackets 80 that span the space between two of the third flanges on a panel and have spaced openings 82 for attachment to the flanges by conventional nails. The number and spacing of openings 82 is such that at least two openings 82 are aligned with openings 54 for receipt of nails 83 for appropriate positioning of bracket 80 on side wall 20. The lower edge of bracket 80 has a slot 84 for receiving the upper inclined end 76 of the support means 24. Thus, a bracket can be secured to each of the panels and the continuous inclined free end 76 will be received into the respective slots 84 to hold the roof structure on the upper end of the side wall 20.

In most conventional structures, the roof structure extends beyond the edge of the side wall of the structure to define eave portions 90, as illustrated in FIG. 1. Preferably, the eave portions are entirely closed and, for this purpose, the building structure incorporates end cap means 92, shown in the lower portion of FIG. 2. The end cap means 92 are designed to completely enclose the space between main body 32 and the flanges 42, 44, 46 extending from opposite lateral edges. The end cap means preferably have tabs 94 extending from opposite edges and adapted to be received into a juxtaposed relation with the first flanges 42 and have upper end portions 96 that are adapted to be received into the V-shaped structure defined between flange 42 and inclined flange 34. The tabs 94 may have deformable portions receivable into openings in flanges 42. Thus, the end cap means 92 completely enclose the lower ends of the roof structure.

The lower exposed surface of the eave portion 90 of the roof structure is also preferably enclosed and sealed by a sealing element 94 extending between the free end of flange 72 out to the lower edge of the end cap 92. If desired, this sealing element 94 could be integral with the lower edge of depending flange 72.

The building structure of the present invention also includes a novel ridge cap means 100 for sealing the space between the upper ends of the respective roof inclined portions of the roof structure 22. As shown in FIG. 1, the cap ridge means 100 consists of a generally V-shaped member 102 that has free end portions on opposite sides of a center ridge 104 which are in overlapping relation with the upper ends of the respective panels that form the roof. The cap ridge means includes a simplified type of attaching means for attaching it to the roof panels without the use of any extraneous tooling. As shown in FIG. 1, the connecting means 106 is in the form of a wire that has a generally U-shaped bite portion 108, the center of which is connected through a bracket 110 to the cap ridge member 102 directly below the center ridge 104. The free ends of the bite portions 108 have leg portions 112, the free ends of which have perpendicular extensions that are receivable into the openings 54 of the third flanges of the structural panel. Thus, the ridge cap means can easily be secured by inserting the extensions through openings 54 and bending them in juxtaposed relation with the third flanges. After this has been accomplished, the bite portion 108 can be twisted to provide an appropriate seal between the overlapping portions of the panels and the ridge cap means 100. Of course, suitable sealing compounds would be inserted therein before the ridge cap member is attached.

The exposed ends of the panel structure are also preferably enclosed by side cap sealing members such as those illustrated in FIG. 6. The side cap sealing member 120 is preferably formed from a non-metallic material so that it is bendable and has a generally V-shaped groove 122 defined at the upper end thereof which is adapted to be received over the V-shaped structure defined on one lateral edge, as explained above. The lower end of the side cap sealing means 120 has an inwardly-directed leg 124 with an inner free end 126. Thus, the side cap member 120 can easily be attached by first inserting the upper V-shaped portion over the lateral portion of the panel and snapping the inner end portion 126 into engagement with the third flange 46 of the panel structure.

According to a further aspect of the invention, the same or a slightly modified form of the panel 30 can be utilized to provide an internal ceiling structure and also partitioning walls for the building structure.

A slightly modified form of structural panel 30A is illustrated in FIG. 3*a*, has a slightly modified main body 32 to produce a generally flat surface that has an inverted V-shaped ridge 36*a* down the center to be used for a ceiling panel. In this embodiment, the inclined flange 40 is eliminated and flanges 42 are integral with the lateral edges of the main body 32A. Flanges 44 and 46 are again configured to receive standard building studding when two adjacent panels are assembled and interconnected. The ceiling panel is specifically designed for use in a multi-story structure where a next adjacent floor would be attached to the studding or joist received into grooves defined by flanges 44 and 46 on adjacent ceiling panels.

The ceiling structure may be attached to the side walls 20 through a suitable bracket structure, that is generally designated by reference numeral 130 and shown in FIGS. 4 and 5. The bracket or support structure 130 consists of a generally L-shaped member 132 that has tabs 134 extending from the vertical leg 136 thereof away from the horizontal leg 138. The tabs 134 are preferably spaced on 16-inch spacings so that they will be in juxtaposed relation to one side of each third flange 42 of each of the panels. Thus, the support member 130 can easily be assembled utilizing nails or other fasteners that extend through the openings in the third flanges (not shown in FIG. 1) and support the ceiling panels 32A (FIG. 1), as well as a floor for the next story.

According to a further aspect of the invention, the ceiling support means 130 is preferably formed in finite lengths and has an interconnecting element 140 that can be interconnected without the use of any special tools. Thus, as illustrated in FIGS. 4 and 5, the horizontal leg 138 has an upwardly-directed flange 142 on the free end thereof and an inwardly-directed flange 144 on the upper end of flange 142. The connecting member 140 is a corresponding L-shaped member including a vertical leg 150, a horizontal leg 152 and an upwardly-directed flange 154 on the free end of the horizontal leg. The connecting member 140 is preferably formed from a non-metallic material so that it can be slightly deformable for assemby purposes. For assembly purposes, the vertical leg 136 of support means 130 has spaced inwardly-bent tabs 160 that define slots, as illustrated in FIG. 5.

The tabs 134 on adjacent ends of the vertical legs are preferably spaced approximately 8-inches from the free end of each support element so that two support elements can be interconnected by inserting the horizontal leg 152 and flange 154 into the corresponding legs in flanges of the support element and the opposite free end can be snapped under the tabs 160. A stressed condition can be developed by deforming the modified panel with a deforming tool adjacent the inner end of the inwardly-directed flange 144 which will prevent horizontal movement of the modified panel.

A slightly modified form of panel structure is illustrated in FIG. 11 wherein the panels are configured to eliminate the need for sealing element 66 that is described in connection with the embodiment described above. In the embodiment illustrated in FIG. 11, the flange structures 42, 44 and 46 are substantially identical to that described in the previous embodiment and the connecting portion between first flanges are the same as described above. In the embodiment illustrated in FIG. 11, the connection between the first lateral edge, such as the left lateral edge of the main panel, is interconnected through an inclined flange 40 integral at the upper end with its upper end of flange 42 . On the opposite lateral edge of the panel, the inclined flange 40 and the first flange 42 are interconnected by a folded portion 200 that is folded into an inverted V-shaped groove formed in conjunction with the first flange 42 and the groove is designed to receive the inverted V-shaped structure formed on the opposite lateral edge of the panel. Thus, in assembling two adjacent panels, the V-shaped groove formed with the folded portion 200 receives the V-shaped structure one the opposite lateral edge and provides a seal between adjacent panels, as shown in FIG. 11.

In all embodiments of the panels described above, the panels can be designed to be connected to the studding or furring through conventional nails or, alternatively, through tabs formed on the panels. As illustrated in FIGS. 12, 13 and 14, the spaced holes 54 on the third flanges are capable of receiving standard nails for attachment to the furring or studding 52. As an alternate means of connection, the openings 54 have spaced parallel slits 210 extending therefrom which define bendable tabs 212 which can be used as an alternate securing means. Thus, in forming the panels, the openings are formed and then the slits 210 are produced, leaving the tabs in alignment with the main body of third flange 46. If the tabs are to be utilized as the securing means, the tabs 212 can be bent inwardly, as illustrated in FIGS. 13 and 14, to provide the securing means to the furring strip or stud 52.

As can be appreciated from the above description, the present invention provides the novel method of constructing an entire building utilizing essentially the same panel configuration, which panels can easily be interconnected to each other and to standard furring or studding of any depth. The present invention provides a novel approach to erection of complete buildings, including exterior walls, interior walls, roof structure and ceiling structure utilizing essentially the same panel configuration which is specifically adapted for use with building studding having a standard width and standard spacing between adjacent studding. The main panel can be fabricated from either steel, aluminum or could also be extruded utilizing plastic materials, if desired. The panel arrangement or construction and configuration is such that the entire vertical height of the wall structure, as well as the length of the roof could be formed from a single panel to eliminate a variety of joints that can conventionally create leakage problems in prior art structures.

It should be noted that, while the panel arrangement has been described as being used with studs, joists, rafters or furring of standard "two" -inch width, in certain non-load bearing installations, the panels could be assembled without any other support by merely interconnecting the first flanges.

I claim:

1. A one piece structural panel for use in erecting buildings by attachment to a building stud having a standard size and profiled for engagement with an adjacent structural panel, said one piece structural panel comprising an elongated, planar main body having parallel lateral edges, each of said lateral edges having a first flange depending substantially perpendicular from said main body, a second flange extending inwardly under said main body from an edge of said first flange opposite said lateral edge and substantially perpendicular to said first flange, and a third flange extending away from, and being generally perpendicular to said main body form an end of said second flange opposite said first flange so that, said second and third flanges define an open slot and the open slots of two adjacent structural panels define a closed slot adapted to receive said standard size building stud.

2. A structural panel as defined in claim 1, in which said first flanges are in abutting relation when adjacent panels are in assembled condition, further including interconnecting means on said first flanges for interconnecting adjacent panels.

3. A structural panel as defined in claim 2 in which said interconnecting means includes tabs bent out of said flanges.

4. A structural panel as defined in claim 1, further including inclined flanges interconnecting said first flanges and said lateral edges and cooperating with said first flanges to define generally inverted V-shaped structures opening toward said second flange.

5. A structural panel as defined in claim 4, further including a folded portion between said first flange and said inclined flange on one edge of said panel with said folded portion cooperating with said first flange to produce a second inverted V-shaped structure along said one edge configured to receive the V-shaped structure on the other edge of said panel when two adjacent panels are assembled.

6. A structural panel as defined in claim 4, in which each inclined flange is integral with an edge of said first flange, further including sealing means adapted to be received between said first flanges and extending over said inclined flanges providing a seal between two adjacent panels in assembled condition.

7. A structural panel as defined in claim 1, further including end cap means adapted to be received between said flanges for enclosing an end of a panel.

8. A building panel comprising a one piece main body having opposite generally parallel first and second lateral edges with inclined portions extending therefrom toward one side of a main plane through said main body, a first flange extending from an end of each of said inclined portions opposite said lateral edges and across said main plane and terminating on an opposite side of said main plane, a second flange extending inwardly of said main body from an end of each of said first flanges opposite said inclined portions and generally parallel to said main plane and a third flange extending generally perpendicular to and away from said main plane from an end of each of said second flanges opposite said first flanges so that said second and third flanges cooperate to form an open groove adapted to receive a building stud.

9. A building panel as defined in claim 8, in which said first flanges and inclined portions cooperate to define inverted V-shaped structures between said first flanges and said first and second lateral edges, respectively.

10. A building panel as defined in claim 9, in which said inclined portion and said first flange on said first lateral edge are interconnected by a folded portion bent away from said main panel to form an inverted groove in conjunction with said first flange adapted to receive the V-shaped structure of an adjacent panel when two panels are in assembled condition.

11. A building panel as defined in claim 9, further including a sealing member having a center leg receivable between adjacent first flanges of two panels in assembled position and two outer legs extending from an exposed end of said center leg and respectively overlying said inclined portions of adjacent panels.

12. A building panel as defined in claim 8, in which said third flanges have spaced openings for receipt of fastening members and spaced parallel slits extending from respective openings that define tabs bendable perpendicular to said flanges to be usable as fasteners for connecting said panels to studs.

13. A building panel as defined in claim 12, in which said first flanges have tabs bendable to interconnect adjacent first flanges of adjacent panels.

14. A building structure having at least one side wall and a roof inclined upwardly from said side wall with the side walls and roof being formed from preformed panels of sheet material, each of said panels having a one piece main body and opposite lateral edges with first flanges depending substantially perpendicular from said main body adjacent said lateral edges and first flanges of adjacent panels being in abutting relation with interconnecting means on said first flanges for interconnecting adjacent panels, second flanges extending substantially perpendicular from said first flanges under said main body, and third flanges depending perpendicular from ends of said second flanges opposite said first flanges, the distance between adjacent third flanges being dimensioned to define a space equal to the width of a standard building stud, and means on an upper end of said wall for supporting said roof on said side wall.

15. A building structure as defined in claim 14, in which said means includes a support member supported on the upper end of said side wall and having spaced depending securing means aligned with at least some of said first flanges with said first flanges having openings for receiving said securing means.

16. A building structure as defined in claim 15, further including brackets adjacent at least some of said third flanges and having a slot for receiving an end of said support member.

17. A building structure as defined in claim 14, further including end cap means on a lower end of each of said panels for enclosing the space between said main body and said flanges.

18. A building structure as defined in claim 17, in which said roof includes two inclined portions extending upwardly from respective side walls and terminating at upper ends spaced from each other and ridge cap means covering the space between the upper ends and including fastener means connected to said third flanges.

19. A building structure as defined in claim 18, in which said fastener means includes a wire having a center portion connected to said ridge cap means and opposite ends with said panel having openings receiving said opposite ends.

20. A building structure as defined in claim 18, further including side cap means attached to exposed flanges for enclosing exposed side portions of said panels.

* * * * *